United States Patent [19]

Hall

[11] 4,086,739

[45] May 2, 1978

[54] WALL CONSTRUCTION HAVING PANEL ATTACHMENT MEANS

[76] Inventor: Raymond L. Hall, 8 Knollwood Trail, E., Brookside, N.J. 07926

[21] Appl. No.: 566,917

[22] Filed: Apr. 10, 1975

[51] Int. Cl.[2] ..... E04B 2/82

[52] U.S. Cl. ..... 52/281; 52/460; 52/461; 52/468; 52/489; 52/501

[58] Field of Search ..... 52/208, 474, 281, 282, 52/489, 498, 499, 420, 465, 468, 501, 593, 582, 584, 586, 460, 461, 469

[56] References Cited

U.S. PATENT DOCUMENTS

| | | | |
|---|---|---|---|
| 2,014,576 | 9/1935 | Legget et al. | 52/582 X |
| 2,304,718 | 12/1942 | Swart | 52/420 X |
| 2,672,621 | 3/1954 | Drain | 52/468 X |
| 2,994,413 | 8/1961 | Levy et al. | 52/36 |
| 3,187,389 | 6/1965 | Anderson | 52/489 |
| 3,189,135 | 6/1965 | Slowinski | 52/282 X |
| 3,197,932 | 8/1965 | Nida | 52/474 |
| 3,199,258 | 8/1965 | Jentoff | 52/468 X |
| 3,229,441 | 1/1966 | Heffner | 52/461 X |
| 3,282,007 | 11/1966 | Campbell et al. | 52/584 X |
| 3,308,590 | 3/1967 | Ettore et al. | 52/281 |
| 3,339,329 | 9/1967 | Berg | 52/460 X |
| 3,350,828 | 11/1967 | Russell | 52/281 X |
| 3,436,881 | 4/1969 | Schlecht | 52/582 X |
| 3,449,877 | 6/1969 | Beckman | 52/282 X |
| 3,457,698 | 7/1969 | Albers | 52/468 X |
| 3,483,665 | 12/1969 | Miller | 52/461 |
| 3,538,667 | 11/1970 | Eri | 52/489 |
| 3,609,933 | 10/1971 | John et al. | 52/461 |
| 3,638,370 | 2/1972 | Miller | 52/586 X |
| 3,751,865 | 8/1973 | Brigham | 52/474 X |
| 3,760,544 | 9/1973 | Hawes et al. | 52/468 X |
| 3,842,560 | 10/1974 | Campbell | 52/582 X |

FOREIGN PATENT DOCUMENTS

| | | | |
|---|---|---|---|
| 579,149 | 7/1959 | Canada | 52/36 |
| 1,109,944 | 2/1956 | France | 52/460 |
| 1,100,255 | 2/1961 | Germany | 52/484 |
| 2,212,645 | 9/1973 | Germany | 52/584 |
| 632,445 | 6/1962 | Italy | 52/501 |
| 91,471 | 4/1959 | Netherlands | 52/486 |
| 1,214,057 | 12/1970 | United Kingdom | 52/474 |

*Primary Examiner*—Leslie Braun
*Attorney, Agent, or Firm*—Ralph R. Roberts

[57] ABSTRACT

This invention pertains to a wall frame construction in which metal studs or frame support members are formed with a panel supporting face. In this face is formed a longitudinal slot or slots terminating at a substantially right angle undercut which provides an internal lip which is substantially parallel with the panel supporting face surface. In combination with the stud is provided a J-clip having a front strip portion and at substantially right angles to its rear face is a stem portion. This stem portion at its free or distal edge is bent into a ninety degree curve and terminates with a very short straight lip extending portion. This curved stem portion of the J-clip is inserted into the slot in the face of the stud and the J-clip is then rotated to bring the lip extending portion behind the internal lip of the undercut in which position the front strip portion of the J-clip provides opposed grooves or channels for retaining the edge of a panel inserted thereunder.

7 Claims, 14 Drawing Figures

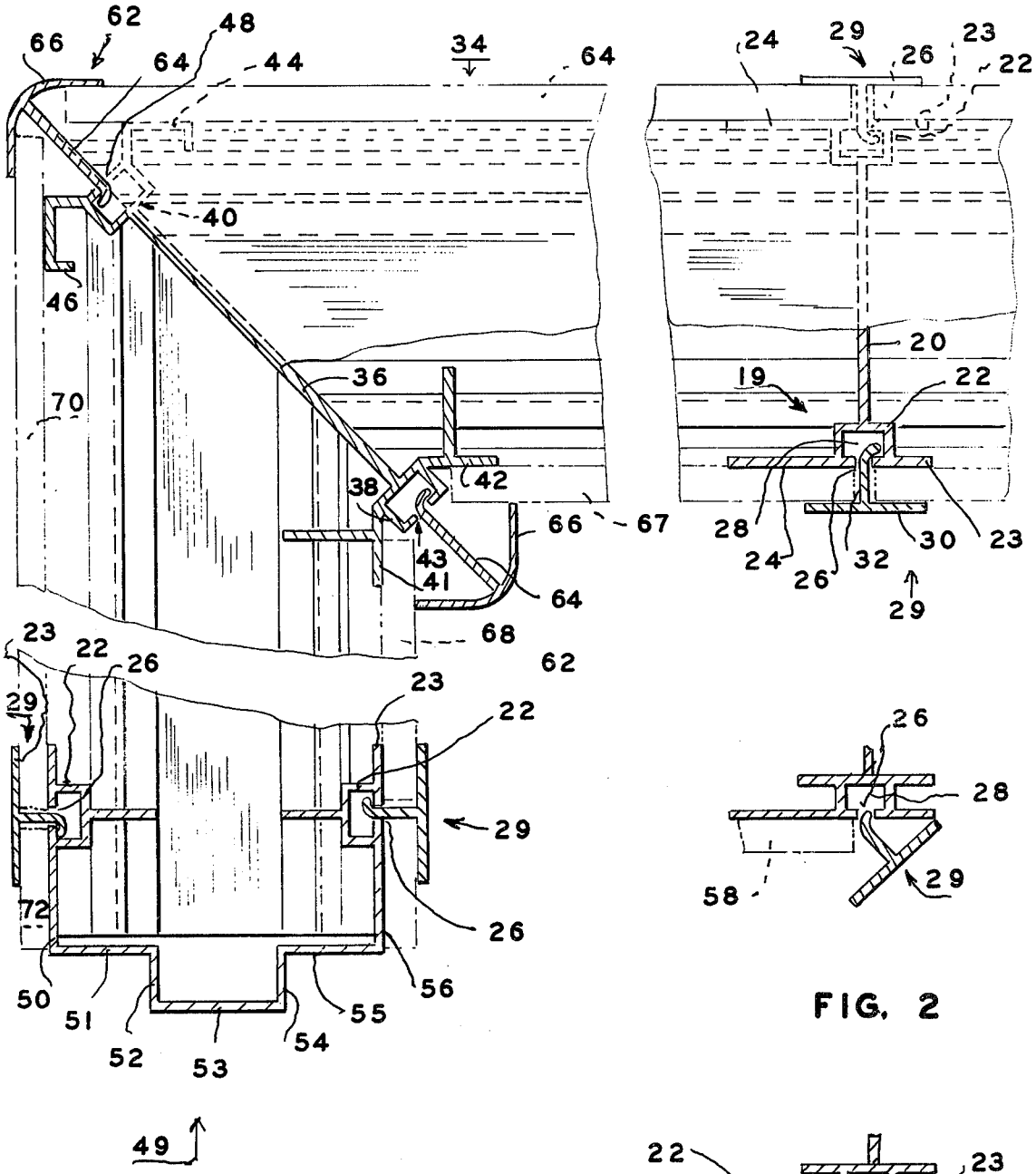
FIG. 1
FIG. 2
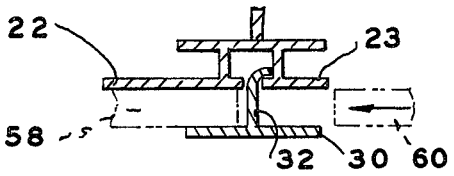
FIG. 3

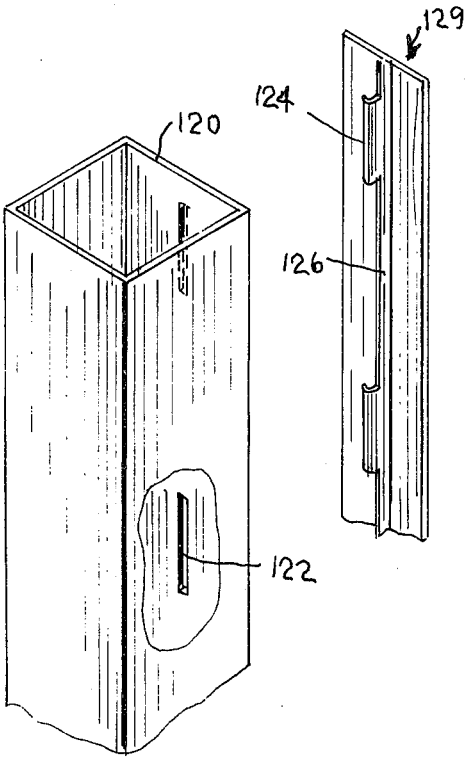
FIG 10
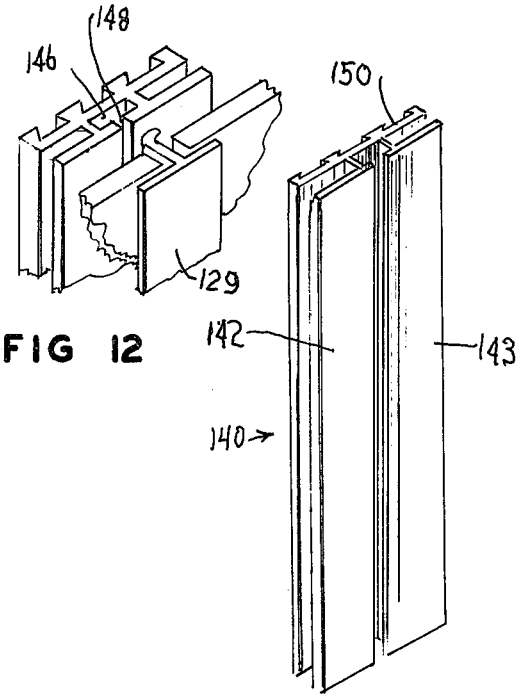
FIG 12
FIG 11
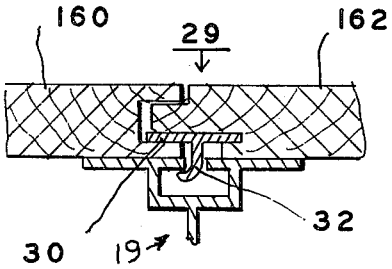
FIG 13
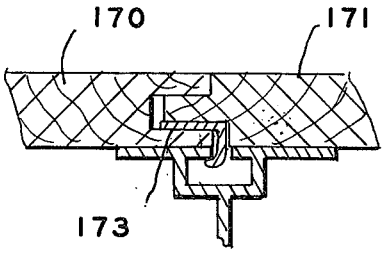
FIG 14

WALL CONSTRUCTION HAVING PANEL ATTACHMENT MEANS

BACKGROUND OF THE INVENTION

1. Field of the Invention

With reference to the classification of art as established in the United States Patent Office the present invention pertains to the general Class entitled, "Static Structures" (Class 52) and more particularly to the subclass entitled, "panel or panel edging directly clamped or adhered to barrier" (subclass 208). Pertinent or associated art is also found in the subclass entitled, "panel held by pre-assembled or pre-positioned frame of shaft" (subclass 474).

2. Description of the Prior Art

The use of aluminum for framing houses, sheds, etc., is, of course, well known and other metal extruded members, of course, may be used. The present invention contemplates the use of an extruded metal stud member which, in installed condition, has a panel supporting surface in which there is provided a slot or slots each having an undercut. At the rear portion of these slots the formed undercut provides a shoulder. Into this undercut slot is mounted the stem portion of a J-shaped clip which in mounted condition is disposed to provide an edge receiving groove sized to snugly retain the edge of a panel, wall-board and the like. The present invention provides a stud construction which is easy to mount in the upper and lower plate members. The securing of the stud to the plate members requires very little assembly effort and with the stud in position the mounting of the panels thereto by one worker, and often as a do-it-yourself structural assembly, is easily accomplished.

In the stud member against which the panel is to be secured there is provided one or more longitudinal slots having an undercut portion with the outer wall portion providing a shoulder. The stem of the J-shaped member has a ninety degree curved tail and a short lip portion which mounts behind this inner shoulder of the undercut to retain the J-shaped clip. When the clip is moved outwardly a groove is established into which the edge of the panel is slid. The J-shaped member usually has equally extending panel retaining portions so that a mating groove is formed in which the edge of an adjacent panel may be slid. The two edges of the adjacent panels are retained with a very thin bit of metal therebetween.

There have been many attempts to provide clips to retain panels to studs. Many of these clips are spring-type retainers which are snapped into holes and because of their spring bias are less than satisfactory in providing a tight, rigid retention of the end of the edge of a panel. As above noted, instead of using a spring bias to retain the clip the J-shaped clip is mounted in a slot and the determined stem length of the J-clip is predetermined to provide a longitudinal edge retaining groove for the edge of the panel.

SUMMARY OF THE INVENTION

This invention may be summarized at least in part with respect to its objects. It is an object of this invention to provide, and it does provide, an efficient means of providing a readily erected wall frame in which the stud portions are of extruded metal. These studs or stud portions have undercut slots having a very narrow outer opening in a supporting face surface against which the edge or ends of the panel are secured to provide a wall surface. These panels are retained in place by a J-clip in which the outer or panel engaging portion of the "J" is a flat plane-line plate which is more-or-less normal to the stem portion. The J-clip, as reduced to practice, is less than one-eighth of an inch in thickness. The stem has its free or inner edge curved with a ninety degree radius terminating with a small extending portion providing an inner lip which in mounted conditions engages the inner portion of the undercut portion of the slot to position the flat face portions from the stud face so as to provide a determined retaining groove into which the end of the studs of the panels are slid for securing to the stud.

In brief, the present invention provides studs to which panels are removably secured. These studs have a slot in their supporting face and an undercut behind this supporting face and adjacent the slot to form either a T-slot with a space portion on both sides of the slot or, in certain instances, on only one side to form an L-shaped slot. It is also contemplated that rectangular or square tubing may have short slots provided in one wall into which the panel retaining members, identified as J-clips, may be mounted. In mounted condition the J-clip forms a channel to provide an edge retaining means for the retaining of panels to the face of the stud member. It is also contemplated that short lengths of grooved members may be provided for adhesive attachment to walls such as basement cement walls. After attachment the groove members provide slot receiving means for receiving the J-clip retainers. The J-clip generally has a flat plate portion and extending from the back of this flat plate portion is a stem portion which is of determined length and generally at right angles to the back face of the retaining front plate portion and at a determined distance from the inner face of this T-junction the stem is bent in a rather sharp curve or arc and then a short lip portion parallel to the front face portion is continued. For assembly purposes, the J-clip is turned sufficiently so that the curved end portion is caused to enter the slot in the stud. The clip is then rotated to move the curved lip portion of the J-clip into the slot with the short lip retained by the inner wall surface of the undercut and the J-clip is prevented from moving directly outward. The groove space between the undersurface of the flat plate portion of the J-clip and the outer face of the stud is precisely established by the formation of the J-clip. This groove snugly receives the edge of a panel to be retained against the stud. This groove space may be one-eighth, one-quarter, three-eighths, one-half inch or some other space distance disposed to accommodate plywood, plasterboard, fiberglas reinforced panels and the like which are secured to the studs to form a wall surface.

In addition to the above summary the following disclosure is detailed to insure adequacy and aid in understanding of the invention. This disclosure, however, is not intended to cover each new inventive concept therein no matter how it may later be disguised by variations in form or additions of further improvements. For this reason there has been chosen several embodiments of a stud having a retaining slot or slots formed in its panel supporting face and in association therewith a J-clip panel retaining means. These embodiments have been chosen for the purposes of illustration and description as shown in the accompanying drawings wherein:

BRIEF DESCRIPTION OF THE DRAWINGS

FIG. 1 represents a plan view, partly in section and showing a wall arrangement including a right angle corner, a doorway end or opening and an intermediate stud all arranged for a J-clip retention of panel members;

FIG. 2 represents a fragmentary plan view and showing the initial insertion of the curved end of the stem portion of a J-clip into a retaining slot in a stud;

FIG. 3 represents a fragmentary plan view of the components of FIG. 2 but with the stem of the J-clip inserted in the undercut and in panel retaining condition;

FIG. 10 represents a fragmentary exploded isometric view of a hollow rectangular stud having short, spaced slots formed in one face and a J-clip member in which the stem is altered to provide matching short hook portions;

FIG. 11 represents a fragmentary isometric view of a special stud member adapted for adhesive mounting to and on cement or cinder block walls;

FIG. 12 represents a fragmentary plan view showing how the attached stud strip of FIG. 11 is used with a J-clip to retain thin paneling to these attached stud strips, and FIG. 13 and FIG. 14 represent fragmentary plan views in which the panels for mounting are formed with mounting grooves enabling the outer plate portion of the J-clip to be concealed.

In the following description and in the claims various details are identified by specific names for convenience. These names, however, are intended to be generic in their application. Corresponding reference characters refer to like members throughout the several figures of the drawings.

Figure 4:
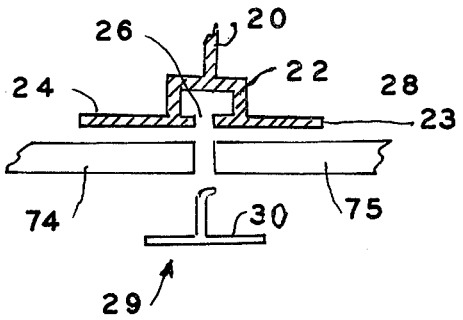
FIG. 4 represents a fragmentary plan view of the components of FIG. 3 in which an alternate method of inserting the stem of the J-clip is employed.

The drawings accompanying, and forming part of, this specification disclose certain details of construction for the purpose of explanation but it should be understood that structural details may be modified in various respects without departure from the concept of the invention and that the invention may be incorporated in other structural forms than shown.

PANEL MOUNTING SYSTEM OF FIG. 1

Referring now to the drawings and in particular to FIG. 1, there is depicted a wall system enabling large ready or precut panels to be readily secured to studs. As shown, a typical stud member 19 includes a web 20 which terminates at both ends with a U-shaped portion 22. The outwardly directed U-shaped portions 22 terminates with front plate portions 23 and 24 which may or may not be the same extent. A slot 26 is provided between the inner edges of plate portions 23 and 24 and preferably extends the full length of the stud. This slot 26 opens into an undercut 28 which is a larger rectangular area and provides the desired undercut groove. The rear or inner surfaces of plate portions 23 and 24 are substantially parallel to the outer surface and adjacent the slot opening 26 provide an inner retaining shoulder for an associated J-clip panel retaining means, hereinafter more fully described.

A J-clip panel retaining means 29, as seen in FIG. 1, preferably is an aluminum extrusion and has a front strip or plate portion 30. Extending from the back and substantially normal thereto is a stem 32 of determined length. The inner or free end of this stem is curved for about ninety degrees and terminates with a short lip extension or portion which is parallel to or substantially paralle1 to the inside plane of front strip 30.

To provide a ninety degree or right angle corner, there is provided a corner stud 34, as seen in FIG. 1, which includes a web 36 which like web 20 terminates with U-shaped portions 38 and 40. Inside plate portions 41 and 42 are integrally attached to U-shaped portion 38 and extend at a forty-five degree angle to the axis of web 36 to provide right angle inside support surfaces. The front face portion of the U-shape 38 has a slot opening 43 like slot opening 26 in U-shape 22. The U-shaped portion 40 at the other end of web 36 is attached to outside plate extensions 44 and 46. These extensions are disposed at a forty-five degree angle to the axis of web 36. The outside plate extension 46 is parallel to inside plate extension 41 and similarly the outside plate extension 44 is parallel to inside plate extension 42. A slot 48 into U-shaped portion 40 provides the entryway for the stem of the associated J-clip.

The stud system may also provide an end stop 49 for doors and other entryways. The intermediate stud 19 is altered to include an end face. The end stop, depicted in FIG. 1, includes web 20 which terminates with outwardly directed U-shaped portion 22 and front plate portion 23. The other plate portion is made as a general channel configuration which extends from the outer U-shape portion 22 to the inner U-shape portion 22. As depicted, from the outer slot 26 a plate portion 50 extends a determined length and then joins at right angles to end stop portion 51. This stop portion 51 is parallel to web 20. A short distance from portion 50 the portion 51 is turned at right angles away from the plane of web 20 to form a jam stop portion 52. After continuing for a short distance jam stop portion 52 is again turned at right angles to form end wall 53 which is parallel to web 20. This end wall 53 joins jam stop portion 54 which is parallel to jam stop portion 52 and is substantially the same length as portion 54. Jam stop portion 54 turns outwardly to form end stop portion 55 which lays in the same plane as end stop portion 51. Portion 55 joins inner plate portion 56 which lays in the same plane as front plate portion 23 and terminates with slot 26. The J-clip 29 is used with the inner and outer slots 26 to retain the panel.

Use and Operation of Stud System of FIG. 1

The erected studs are secured at their ends to upper and lower plates or other retaining means. The spacing of the studs is made to suit the width of the panels to be provided, usually about four feet. With the studs secured, usually vertically, the J-clip 29 is brought to the slot 26. The bent end and stem is inserted in and through the slot and having a sufficient thinness enabling free entry of this bent stem through this slot after which it is rotated as in FIG. 2. The curved end of the stem 32 after insertion into this slot is then manipulated to the position as in FIG. 3 to bring strip portion 30 parallel to front plate portions 23 and 24. The right end of a panel 58, shown in phantom outline, is inserted into the tight fitting groove established by U-shaped portion 22, stem 32 and strip 30. This groove is maintained by the insertion of the left edge of a panel 60, shown in phantom outline, and moved in the direction of the arrow into the groove established by plate portions 23, the right side or face of stem 32 and strip 30. The stem 32 is precisely formed so that the spacing of strip 30 from plate portion 23 and 24 establishes a snug engagement for the edges of the panels 58 and 60.

A J-clip 62 associated with the right angle corner stud has a stem 64 whose inner or undercut engaging end is curved and terminates with a short lip. The panel retaining portion of J-clip 62 includes a partly curved face member 66. When mounted in slot 43 the ends of face member 66 are spaced from the face of plate portions 41 and 42 a distance which corresponds to the thickness of the panel to be mounted. When the J-clip 62 is mounted in slot 48 the undersurfaces of the extending portions of the face member 66 define a right angle and are spaced from the face of plate extensions 44 and 46 a distance which corresponds to the thickness of the panels to be retained by this mounted J-clip.

Mounting of Panels as in FIG. 1

As seen in FIG. 1, an inner panel 67 is secured to stud 19 and corner stud 34 by means of the J-clip 62 which is mounted with the hook end into the slot 43 and rotated into the position shown. The left end or edge of panel 67, shown in phantom outline, is slid under the end of member 66 of J-clip 62 while the end of a panel 68 is slid into position under the other end of member 66. Panel 67 is retained at its other end by a J-clip 29 mounted in slot 26. The panel 68 rests against the inside plate portion 41 and by means of the J-clip 62 is retained in position while the other end of the panel 68 is retained by J-clip 29 retained in the slot 26 of end stop 49. The outer panels identified as 69 and 70 are retained by a J-clip 62 mounted in the outer slot 48 and rotated into position. The inner surface of the curved face 66 of J-clip 62 retains a left end of the panel 69 and the front plate portion 24 and a J-clip 29 in slot 26 of stud 19 retains the other end. The outside plate 44 establishes the support surface for panel 69 on the corner stud 34 and the other end of this panel is retained in position on stud 19 by means of J-clip 29 mounted in slot 26.

The panel 70 is also slid into and retained in position on corner stud 34 and end stop 49. One end is retained by J-clip 62 and the other end by J-clip 29 rotated into position in slot 26 to retain the panel 70 in position. The end stop 49 may form part of a doorway and to cover the plate portions 50 and 56 and also to maintain the J-clips 29 in position to retain the panels 70 and 68 there is provided short pieces of panel, identified as 71 and 72. These short pieces are cut to width and inserted into the groove formed by the J-clip 29 and the plate portions 56 and 50. When tightly inserted, each holds the associated J-clip tightly in position and also finishes off the wall.

Retaining Means of FIG. 4

Referring next to FIG. 4, there is depicted a stud similar to stud 19 seen in FIG. 1. This stud also has a web 20, an outward U-shaped portion 22 and a slot 26 defined by the right and left front plate portions 23 and 24. Panels 74 and 75 are retained against these plate portions by means of a J-clip 29 in which the panels are brought into position adjacent the slot 26 with the stem of the J-clip retained between the ends of the panel 74 and 75. The curved end of the stem is brought adjacent slot 26 and the installer strikes the front strip 30 of the J-clip 29 so that the curved end is driven into the undercut recess 28. The side walls of the U-shaped portion 22 are deflected away from each other and act as leaf springs permitting front plate portions 23 and 24 to move apart to pass the bent end of the J-clip 29. After the bent end has passed through the slot 26 the side walls of the U-shape spring back into initial condition to retain the J-clip 29 in position.

Figure 5:
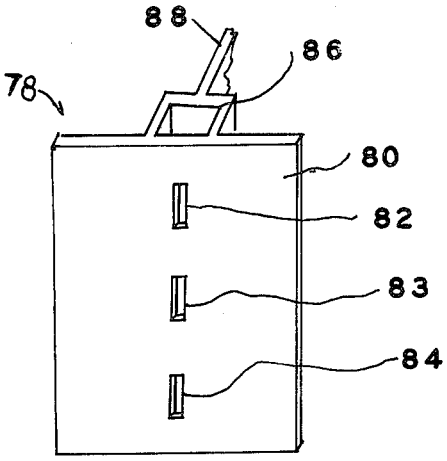
FIG. 5 represents a fragmentary front view of a stud whose front face has short slot openings in which are mounted short J-clip members.

Embodiment of FIG. 5

It is to be noted that although the stud preferably is an extrusion with a web and a U-shaped undercut as in FIG. 1, a slot along the complete length is not required. Short slots may be provided such as is depicted in FIG. 5. As illustrated a stud 78 has a front face portion 80 in which is punched or formed short slots 82, 83 and 84. These slots are only representative of a series of substantially similar slots which may be formed in the front face 80. These slots are open to the interior of the undercut provided by the U-shaped portion 86. A web 88 may extend to an opposite like side. A J-clip is cut into short lengths so that the stem portion may easily fit into one of the several openings 82, 83 or 84. The short lengths of J-clips 29 provide a desired pattern along the edges of a panel if such is desired.

Figure 6:
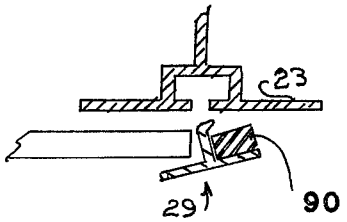
FIG. 6 and FIG. 7 represent fragmentary plan views showing the slots of studs and J-clips as used with sponge rubber to retain a panel of plastic.

Panel Retaining Means as Depicted in FIG. 6

Referring next to FIG. 6, there is shown a means of retaining the edge of only one panel by a J-clip 29. In some instances it may be desirable to terminate the panel sequence while using the J-clip 29 to retain one panel in position. When this condition occurs a sponge rubber strip 90 may be inserted between front plate portion 23 and the front strip 30 to retain the J-clip 29 in position. This sponge rubber or similar resilient means 90 may be a long strip or may be several short pieces.

Figure 7:
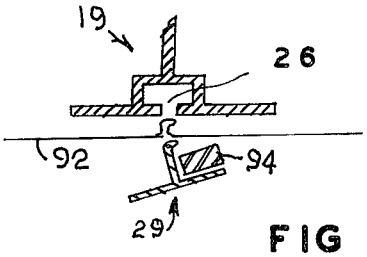

Sheet Retaining Means as Depicted in FIG. 7

In FIG. 7 is diagrammatically shown a thin rubber or plastic sheet 92 retained by means of a J-clip 29. When and where desired, a thin wall covering of sheet material rather than stiff panels may be mounted to studs 19. This sheet material 92 may be placed against several studs after which the J-clip 29 is forced into the slot 26. The sheet material is caused to be drawn around the protruding stem 32 of the J-clip 29 and into the slot 26. This pushing of the material into the slot tends to draw the plastic sheet 92 into a taut condition. It may be desired that a thin sponge rubber strip 94 be provided on the underside of the J-clip 29 to urge the J-clip 29 outwardly and the bent end into engagement with the undercut.

Figure 8:
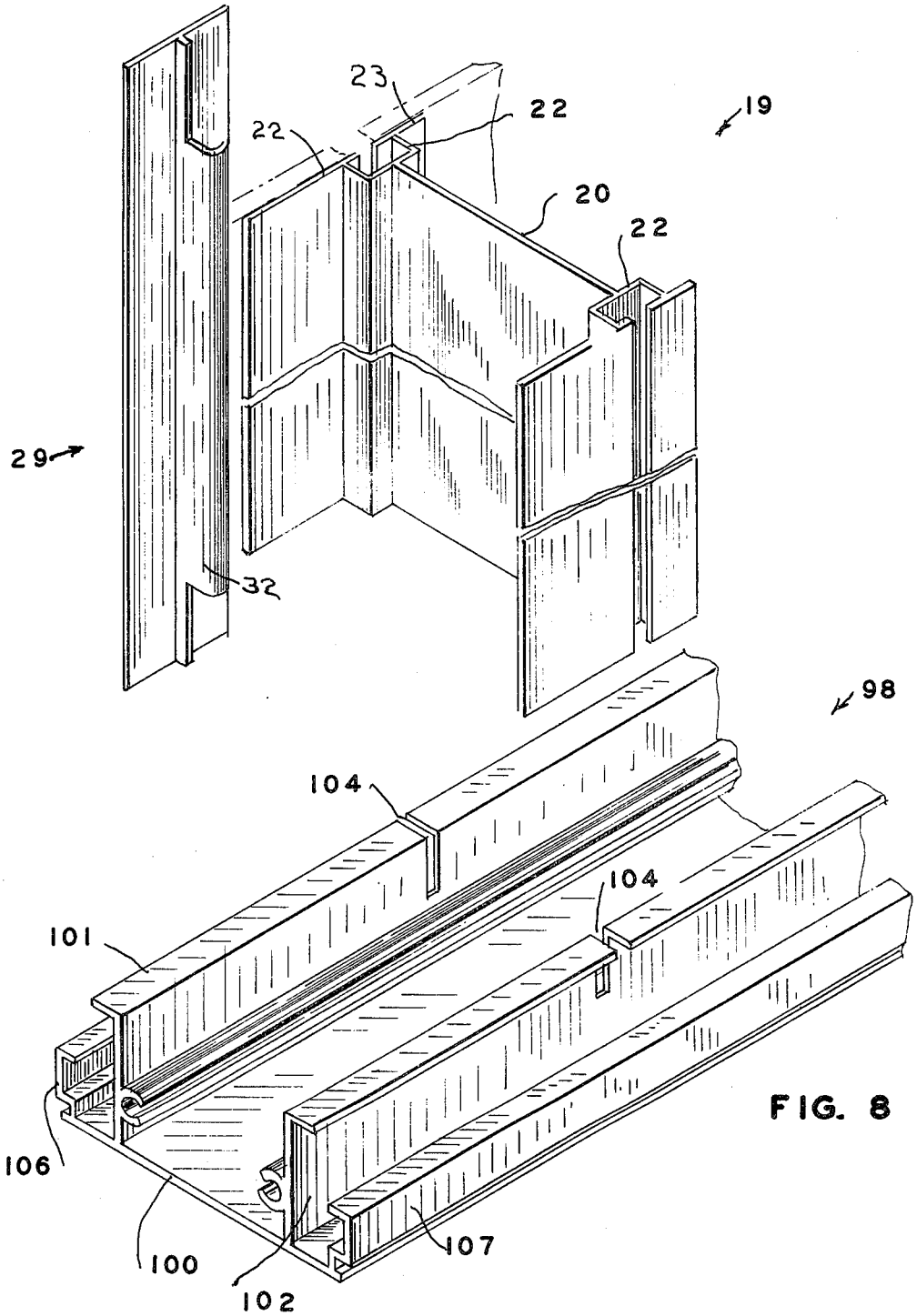
FIG. 8 represents an exploded isometric view of a stud adapted for mounting panels on opposite faces and showing a suggested means for retaining the studs in and on like floor and ceiling plates.

Typical Stud Retention as Seen in FIG. 8

Referring next to FIG. 8, there is shown one means for securing the end of a stud. As exemplified, a stud 19, such as seen in FIG. 1, has its end cut square and the ends of web 20, U-portions 22 and front plate portions 23 and 24 lay in a common plane. This end is seated in a floor and/or ceiling plate. A floor plate 98 is depicted and from a back portion 100 has two ear members 101 and 102 whose outwardly turned edges are sized to slidably engage the inner edges of U-shaped portion 22. Transverse saw slots 104 are formed in ears 101 and 102 to receive and engage the web 20 of the stud 19. The outer front plate portions 23 and 24 of the stud 19 rest upon outer shoulders 106 and 107 of plate 98. J-clip 29, as depicted, has a longitudinal length in which end portions of the stem 32 are removed so as to lay adjacent the outer face of shoulder 106. The J-clip thus extends from the floor to the top of a ceiling plate when desired. The stud may be fixed in the floor plate simply by the saw slots 104 engaging web 20 or by other securing means such as glue, welding, pins, screws and the like. The method and means of securing the stud to the floor and/or a top plate, whether metal or wood, is merely a matter of selection.

Figure 9:
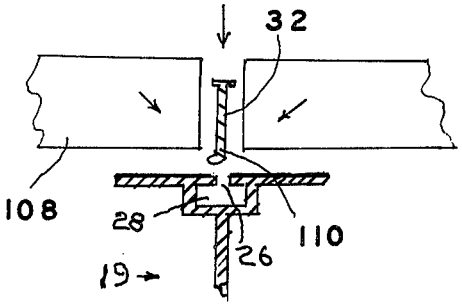
FIG. 9 represents a plan view, partly in section, of a slotted stud and an altered J-clip used to position and retain cast patio blocks.

Patio Block Retaining Means of FIG. 9

Referring next to FIG. 9, it is to be noted that in certain instances the panels may, instead of being large in size, be small rectangular blocks 108 such as cast patio blocks of cement or cinder cement composition. Where these blocks are to form a wall or slope the precise retention is essential. In this embodiment there is provided stud-like members 19 which may be either vertical, horizontal or sloped or combinations thereof into which short pieces of J-strips identified as 110 are mounted. On J-strip 110 no outer retaining means is provided, each J-strip being positioned with the bent stem end 32 retained in the recess 28 and extending outwardly through the slot 26. Patio blocks 108 are depicted as being retained in aligned position and the J-strips 110 maintain the blocks against shifting. Adhesive may be used, if desired, to retain the blocks to stem portion 32. If the blocks 108 are to be used in the side walls of a swimming pool the regular J-clip 29 may be used since a liner covers the front strip portion 30.

Stud System of FIG. 10

Referring next to FIG. 10, it is to be noted that instead of a stud 19, as depicted in FIGS. 1 and 8, a rectangular tube 120 may be employed. This tube has slots 122 punched in one face thereof and these slots with the wall thickness of the tube provide the undercut requirements for mounting and holding the positioned segments 124 of the stem 126 of J-clip 129. The several segment portions are slightly less in length than the similar length of slots 122 and are spaced in accordance with the positioning of the slots so that when mounted in position the J-clip 129 provides the required capability of holding the edges of the panel in accordance with the teachings of FIGS. 2 and 3.

Alternate Stud Construction of FIGS. 11 and 12

Depicted in FIGS. 11 and 12 is a wall stud 140 disposed to retain panels as a covering for a cement or cinderblock wall such as is found in the basements of houses. In this retaining means is shown a wall stud 140 having outer face supports 142 and 143 which in the manner of the above-described studs provides an undercut 146 in combination with a slot 148. The undercut portion rather than being formed with a U-shape joined to a single web, instead has two short beam portions which join a flat plate portion 150 which may or may not have ribs. When ribs are employed they enable adhesive to be used to retain stud member 140 to cement or block walls and the like. The grooves are aligned and after the adhesive has dried or set these wall studs 140, which may be three or four inches in length, provide a groove in which short length J-clips 129 or a full length J-clip 29 can be mounted. The J-clip retains panels in the above-identified manner against the outer face supports 142 and 143. Panels are sequentially retained by J-clips as above-described.

Retaining of Specially Grooved Panels as in FIGS. 13 and 14

Referring next and finally to FIGS. 13 and 14, there is depicted a means for retaining panels to a stud 19 in a manner by which the J-clip 29 is conceales. As seen in FIG. 13, mating panels 160 and 162 are made with tongue and groove edges. The tongue and groove is altered to provide a space in which is received the front strip portion 30 of the J-clip 29. The mounted J-clip is positioned in the undercut and in the slot 26 of the stud the right and left panels 160 and 162 are brought together to cause the tongue and groove to meet and mate. When precisely made the tongue and groove enables a very thin line of joining to be discerned. The clip is trapped in the preformed recess formed in the inner portions of the tongue and groove of the panels 160 and 162.

FIG. 14 shows an alternate means of retaining mating tongue and groove joined panels. Tongue and groove panels 170 and 171 have the tongue and groove altered so as to receive and retain a J-clip 173 in which the right-hand portion of a face strip 30 is removed so that only one face strip portion remains. This portion and the stem are trapped in an appropriately formed recess in the tongue and groove configuration. When panels 170 and 171 are pushed together in the desired assembled condition the trapped J-clip 173 retains them against the face of the stud.

Whether the J-clip is made with a straight front strip 30 as in clip 29 in FIG. 1 or a curved face member 66 with the J-clip 62 also of FIG. 1, the front portion is in shear and/or bending against outward displacement. In the J-strip of FIG. 9 and others contemplated where the outer surface of the wall is to be smooth, an adhesive, cement or small side projections or perforations in the stem may be provided to assist retention. The means of retention provided by the J-strip is a matter of selection.

The shoulder which is engaged by the curved end of the stem of the J-clip is usually parallel with the face of the stud. It is to be noted, however, that a shoulder surface having a slope of as much as 60° to the face may be used providing that the slot be sufficiently narrow and the curved end of the stem be compatibly formed.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the studs and retaining J-clips may be constructed or used.

While particular embodiments have been shown and described it is to be understood the invention is not limited thereto since modifications may be made within the scope of the accompanying claims and protection is sought to the broadest extent the prior art allows.

What is claimed is:

1. A wall construction including a plurality of panel members of like selected thickness and a panel attachment means provided by a combination of components, said attachment means including a plurality of studs, each stud having a selected length and being formed with at least one outer panel member supporting face, at least one slot portion longitudinally disposed and formed in said supporting face of each of said studs, an undercut formed in each of said studs and being aligned with said slot, the undercut being formed to open to the slot and providing at least one shoulder surface parallel with the supporting face and being disposed a predetermined short distance from the supporting face, said studs being arranged in a selected order, said panel members being secured to said studs by a plurality of J-clips which are rotatably and removably mounted to the studs, each J-clip including a main stem portion having a first and second bar element extending a short distance in an angular manner from a first end of the main stem portion and forming panel member engaging portions and the opposed end of the main stem having a bent stem end portion extending to one side out of the plane of the main stem and deviating at least thirty degrees from the plane of the main stem, a first one of the panel members being located in position against the supporting surface of one of the studs so that said slot of said stud is exposed, and said first panel member being located in position prior to insertion of a J-clip in said slot, a second one of said panel members being located in position and against the supporting surface of said one of said studs so that said slot is exposed and a second panel member being positioned subsequent to insertion of said J-clip, said bent stem end portion and said lower portion of the main stem adjacent the bent stem end portion being sized and inserted in and through said slot and with a rotatable manipulation of the J-clip the bent stem end portion is brought into engagement with the engaging shoulder of the slot with the panel member engaging portion of the clip brought into a position substantially parallel to the panel supporting face of said stud, the bent stem end portion extending laterally of the main stem a distance greater than the width of said slot, the main stem of said J-clip member having a length so that the panel member engaging portion of the J-clip is sized and is precisely spaced from the panel supporting face of the said one of the studs a distance substantially equal to the first panel member thickness and said first panel member being positioned in a channel formed between the panel supporting face of the said one of the studs, the main stem portion and said first bar element, and said second panel member being secured to the said one of the studs and being positioned in a channel formed between the panel supporting face of the said one of the studs, the main stem portion and the second bar element, said second panel member being positioned subsequent to said insertion of the J-clip member in the slot of the said one of the studs.

2. A wall construction as in claim 1 in which the J-clip has its bent stem end portion formed so as to deviate about ninety degrees and in only one direction from the plane of the stem, this bent stem end position further formed with a short extending lip portion and in which the undercut in the stud is formed so as to provide a shoulder portion on each side of the opening, each shoulder substantially parallel with the associated panel supporting face.

3. A wall construction as in claim 1 in which the J-clip has said first and second bar elements being in a plane substantially normal to the stem and being integral therewith.

4. A wall construction as in claim 1 in which the stud is a metal extrusion having a web portion terminating at U-shaped portions whose legs are connected to front plate portions laying in a plane substantially normal to the plane of the web, the space between adjacent front plate portions establishing a continuous slot of determined width.

5. A wall construction as in claim 1 in which the slot in the stud is a rectangular aperture formed in the supporting face.

6. A wall construction as in claim 1 in which the stud is a rectangular tube.

7. A wall construction as in claim 1 in which the stud is an extrusion having a configured back portion opposite the supporting face, said back portion having means for attaching the stud as by adhesive to cement, cinder block, plaster and like walls.

* * * * *